US008192222B2

(12) United States Patent
Kameyama

(10) Patent No.: US 8,192,222 B2
(45) Date of Patent: Jun. 5, 2012

(54) ELECTRICAL CONNECTOR WITH AN ELECTRICAL WIRE HOLDING MEMBER

(75) Inventor: Isao Kameyama, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/055,082

(22) PCT Filed: Jul. 22, 2009

(86) PCT No.: PCT/JP2009/063082

§ 371 (c)(1),
(2), (4) Date: Jan. 20, 2011

(87) PCT Pub. No.: WO2010/010883

PCT Pub. Date: Jan. 28, 2010

(65) Prior Publication Data

US 2011/0136391 A1 Jun. 9, 2011

(30) Foreign Application Priority Data

Jul. 22, 2008 (JP) ..... 2008-188448

(51) Int. Cl.
*H01R 4/24* (2006.01)

(52) U.S. Cl. ..... 439/404

(58) Field of Classification Search ..... 439/499, 439/417, 404, 497, 607.42–607.52
See application file for complete search history.

(56) References Cited

U.S. PATENT DOCUMENTS

| | | | | |
|---|---|---|---|---|
| 6,123,582 | A * | 9/2000 | Ko et al. | 439/579 |
| 6,139,363 | A * | 10/2000 | Ko et al. | 439/579 |
| 6,217,344 | B1 * | 4/2001 | Saito et al. | 439/67 |
| 6,692,294 | B2 * | 2/2004 | Kobayashi | 439/496 |
| 6,957,981 | B2 * | 10/2005 | Karino et al. | 439/606 |
| 7,347,738 | B2 * | 3/2008 | Hsieh et al. | 439/687 |
| 7,494,367 | B2 * | 2/2009 | Adachi et al. | 439/499 |
| 7,628,647 | B2 * | 12/2009 | Semba et al. | 439/579 |
| 2003/0129875 | A1 | 7/2003 | Ho | |
| 2005/0014417 | A1 * | 1/2005 | Karino et al. | 439/606 |
| 2011/0130030 | A1 * | 6/2011 | Morita | 439/499 |

FOREIGN PATENT DOCUMENTS

| | | |
|---|---|---|
| JP | 2004-039612 A | 2/2004 |
| JP | 2005-123100 A | 5/2005 |
| JP | 2005-149935 A | 6/2005 |
| JP | 2006-120364 A | 5/2006 |

OTHER PUBLICATIONS

International Search Report (PCT/ISA/210) issued in PCT/JP2009/063082, dated Aug. 18, 2009.

* cited by examiner

*Primary Examiner* — Tulsidas C Patel
*Assistant Examiner* — Harshad Patel
(74) *Attorney, Agent, or Firm* — Sughrue Mion, PLLC

(57) ABSTRACT

A connector includes plurality of terminal fittings, a terminal holding member for holding the plurality of terminal fittings, and an electric wire holding member which is attached to the terminal holding member and holds plural electric wires. The electric wire holding member has a plurality of electric wire holding parts which hold ends of the plurality of electric wires at the same spacing as intervals between the plurality of terminal fittings and also are arranged in parallel with space in a longitudinal direction of the plurality of terminal fittings, and an exposure part for exposing exposed portions of core wires of the plurality of electric wires to the outside in order to connecting the exposed portions to the plurality of terminal fittings.

6 Claims, 4 Drawing Sheets

ELECTRICAL CONNECTOR WITH AN ELECTRICAL WIRE HOLDING MEMBER

TECHNICAL FIELD

The present invention relates to a connector used in connection etc. of an electric wire, and particularly to the connector used in connection etc. of a twisted pair cable in which plural coated electric wires are twisted.

BACKGROUND ART

In an electronic device in which reduction in size and weight, high functionality, etc. accelerate in recent years, a saving in space, thinning, etc. of an electric cable used in the case of mutually connecting electronic components of the inside of the electronic device are also desired. Because of this, as the electric cable, for example, the so-called thin flat cable such as an FPC (flexible print circuit) or an FFC (flexible flat cable) in which plural conductors with a rectangular sectional shape are juxtaposed is used. Then, the electronic device is connected to the flat cable by mutually fitting connectors respectively included by the electronic device and the flat cable.

As the connector described above, for example, a connector in which a connector including plurality of terminal fittings, a connector housing for receiving the plurality of terminal fittings, etc. is used and the plurality of terminal fittings of the connector and plural conductors exposed by removing an insulator, a shield body and a sheath of a flat cable are electrically connected and assembled using a laser etc. as a method for attaching this connector to a distal end of the flat cable is proposed (for example, see Patent Literature (PTL) 1).

The connector disclosed in PTL 1 is constructed of an insulating material and includes the plurality of terminal fittings. The plurality of terminal fittings are respectively made of conductive sheet metals etc. and are formed in a band plate shape. The plurality of terminal fittings are mutually spaced and are juxtaposed to the connector in parallel.

The flat cable to which the connector described above is attached is formed in a flat band shape including the plurality of conductors made of conductive metals, the insulator for coating the conductors, the conductive shield body for covering the outside of the insulator and the insulating sheath for coating the outside of the shield body. In the flat cable, distal ends of plural core wires exposed by removing the insulator, the shield body and the sheath by a predetermined length are fixed with the plurality of core wires parallel mutually by a film-shaped loose prevention part made of, for example, resin or paper.

In the connector described above, the plurality of core wires fixed by the loose prevention part of the flat cable are abutted on the plurality of terminal fittings, and the plurality of terminal fittings and the plurality of core wires are irradiated with a laser and thereby, the plurality of terminal fittings and the plurality of core wires are welded and are respectively connected. In this manner, the connector is electrically connected to the flat cable.

CITATION LIST

Patent Literature

[PTL 1] JP-A-2006-120364

SUMMARY OF INVENTION

Technical Problem

In the connector disclosed in PTL 1, the plurality of mutually parallel core wires of the flat cable are abutted on the plurality of terminal fittings and the plurality of core wires of the flat cable are connected to the plurality of terminal fittings by laser welding and the connector is electrically connected to the flat cable.

However, when the connector is connected to a twisted pair electric wire constructed by twisting plural electric wires, the twisting is left in a state of untwisting the plurality of electric wires and peeling a coat part etc. and exposing core wires, and the core wires of the plurality of electric wires are not arranged in parallel mutually, so that it was difficult to be irradiated with the laser in a state of respectively abutting the core wires of the plurality of electric wires on the plurality of terminal fittings of the connector. As a result, there was a problem of requiring time and effort to do work of connection between the plurality of electric wires and the plurality of terminal fittings of the connector.

Therefore, an object of the invention is to provide a connector capable of easily making connection between the plurality of terminal fittings and the plurality of electric wires.

Solution to Problem

In order to solve the problem and achieve the object, the invention provide a connector comprising:

a plurality of terminal fittings, a terminal holding member that holds the plurality of terminal fittings; and an electric wire holding member that is attached to the terminal holding member and is configured to hold a plurality of electric wires, wherein the electric wire holding member includes:

a plurality of electric wire holding parts that hold ends of the plurality of electric wires at the same intervals as intervals between the plurality of terminal fittings and are arranged in parallel with space in a longitudinal direction of the plurality of terminal fittings; and an exposure part for exposing exposed portions of core wires of the plurality of electric wires to the outside in order to connecting the exposed portions to the plurality of terminal fittings.

Preferably, the terminal holding member is provided with a first retaining portion, the electric wire holding member is provided with a second retaining portion, and the terminal holding member is mutually fixed to the electric wire holding member in a state that the exposed portions of the core wires of the plurality of electric wires respectively bring into contact with one ends of the plurality of terminal fittings in the longitudinal direction by engaging the first retaining portion with the second retaining portion.

Here, it is preferable that, abutting parts protruded from the one ends of the plurality of terminal fittings toward the core wires are formed on the one ends of the plurality of terminal fittings respectively, and lengths of the plurality of terminal fittings in the longitudinal direction are set so that the abutting parts bring into contact with the exposed portions of the core wires respectively.

Preferably, the exposure part is space and is arranged between the plurality of electric wire holding parts, and the plurality of electric wire holding parts hold insulating coat parts of the plurality of electric wires.

According to the above configuration, the electric wire holding member has the plurality of electric wire holding parts which hold the ends of the plurality of electric wires at the same intervals as the intervals between the plurality of terminal fittings and also are parallel spaced in the longitudinal direction of the plurality of terminal fittings, and the exposure part for exposing the exposed portions of the core wires of the plurality of electric wires to the outside in order to connecting the exposed portions to the plurality of terminal fittings, thereby attaching the electric wire holding member to the terminal holding member, the ends of the plurality of electric wires can be respectively positioned in the plurality of terminal fittings and also the portions exposed to the ends of the plurality of electric wires of the core wires of the plurality of electric wires positioned in each of the plurality of terminal fittings can be exposed from the exposure part (space) of the electric wire holding member.

Also, according to the above configuration, the terminal holding member is fixed to the electric wire holding member in the state that the exposed portions of the core wires of the plurality of electric wires respectively bring into contact with one ends of the plurality of terminal fittings in the longitudinal direction by engaging the first retaining portion of the terminal holding member with the second retaining portion of the electric wire holding member, so that the state that the exposed portions of the core wires of the plurality of electric wires respectively brings into contact with one ends of the plurality of terminal fittings can be held by fixing the terminal holding member to the electric wire holding member.

Also, according to the above configuration, the abutting part for protruding from the one end toward the core wire is formed on the one end of each of the plurality of terminal fittings, and the lengths of the plurality of terminal fittings in the longitudinal direction of the plurality of terminal fittings are set so that the abutting parts bring into contact with the exposed portions of the core wires, so that the portions exposed to the ends of the plurality of electric wires of the core wires of the plurality of electric wires can surely be respectively brought into contact with one ends of the plurality of terminal fittings in the case of fixing the terminal holding member to the electric wire holding member.

Advantageous Effects of Invention

As described above, by attaching the electric wire holding member to the terminal holding member, the ends of the plurality of electric wires can be respectively positioned in the plurality of terminal fittings and also the portions exposed to the ends of the plurality of electric wires of the core wires of the plurality of electric wires positioned in each of the plurality of terminal fittings can be exposed from the exposure part of the electric wire holding member, so that positioning of the plurality of terminal fittings and the ends of the plurality of electric wires is facilitated and also the plurality of terminal fittings and the portions exposed to the ends of the plurality of electric wires of the core wires of the plurality of electric wires can easily be respectively welded by laser welding etc. As a result, connection between the plurality of terminal fittings and the plurality of electric wires can easily be made.

Also, the state in which the portions exposed to the ends of the plurality of electric wires of the core wires of the plurality of electric wires respectively bring into contact with one ends of the plurality of terminal fittings can be held by fixing the terminal holding member to the electric wire holding member, so that the portions exposed to the ends of the plurality of electric wires of the core wires of the plurality of electric wires can be exposed from the space of the electric wire holding member in the state of respectively abutting on one ends of the plurality of terminal fittings and thus, the plurality of terminal fittings and the portions exposed to the ends of the plurality of electric wires of the core wires of the plurality of electric wires can surely be respectively welded by laser welding etc. As a result, connection between the plurality of terminal fittings and the plurality of electric wires can surely be made.

Also, the portions exposed to the ends of the plurality of electric wires of the core wires of the plurality of electric wires can surely be respectively abutted on one ends of the plurality of terminal fittings in the case of fixing the terminal holding member to the electric wire holding member, so that the portions exposed to the ends of the plurality of electric wires of the core wires of the plurality of electric wires can be exposed from the space of the electric wire holding member in the state of respectively surely abutting on one ends of the plurality of terminal fittings. As a result, the plurality of terminal fittings and the portions exposed to the ends of the plurality of electric wires of the core wires of the plurality of electric wires can more surely be welded by laser welding etc.

DESCRIPTION OF EMBODIMENTS

A connector according to a first embodiment of the invention will hereinafter be described with reference to FIGS. 1 to 6. Plural electric wires 10 of an electric cable 2 used in the case of mutually connecting electronic components of the inside of an electronic device (not shown) are connected to a connector 1 according to the first embodiment of the invention and the connector 1 is fitted into a connector of the other side (not shown) and the electronic components are mutually connected.

Figure 1:
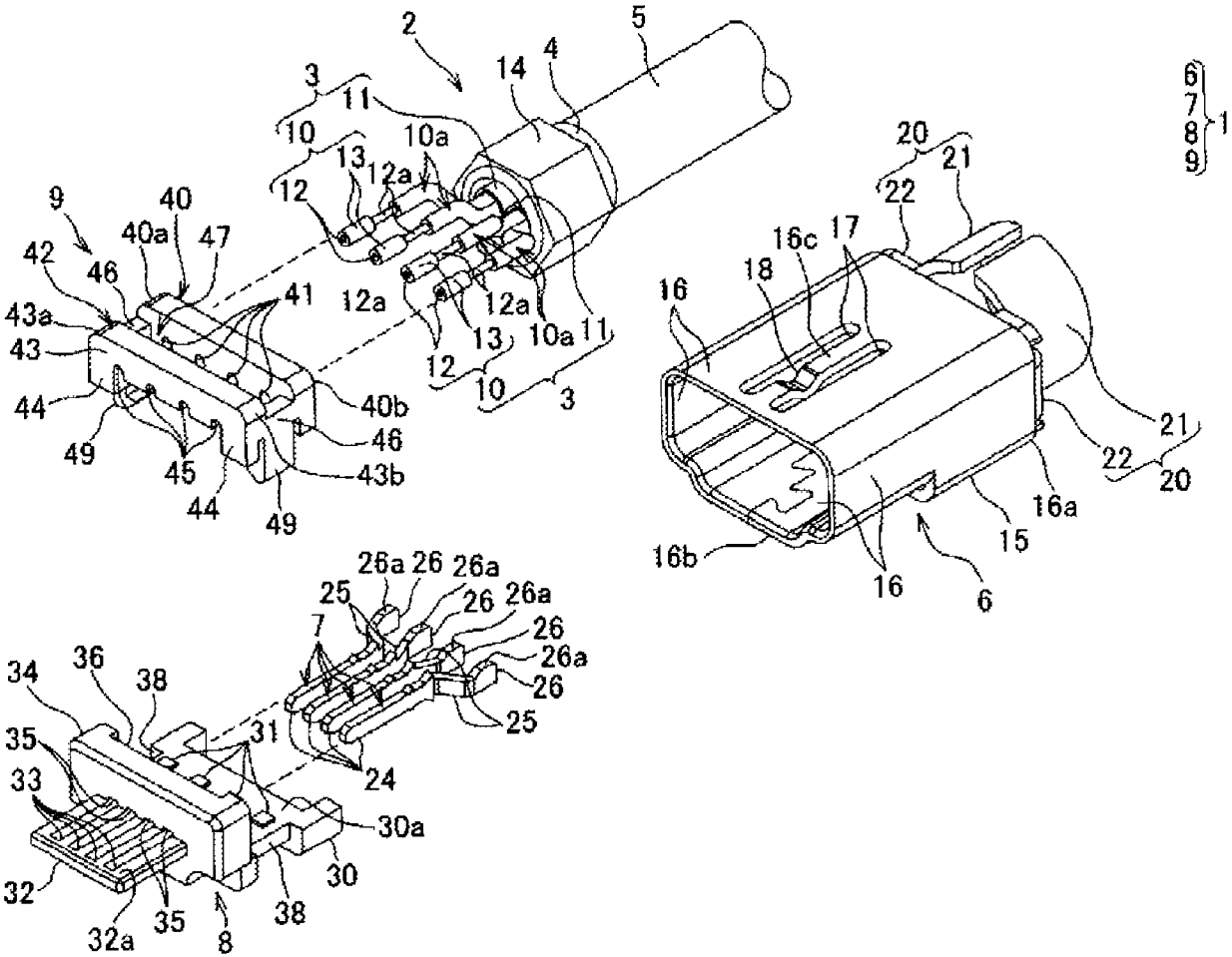
FIG. 1 is an exploded perspective view showing a connector according to an embodiment of the invention.

The electric cable 2 includes plural twisted pair wires 3, a conductive braided wire 4 for coating the outer periphery of the plurality of twisted pair wires 3 and a sheath 5 for covering the outer periphery of the braided wire 4 as shown in FIG. 1.

As shown in FIG. 1, there are the two twisted pair wires 3 in an illustrated example and the two twisted pair wires are bundled in mutually parallel (that is, concurrently). Each of the plurality of twisted pair wires 3 includes the plurality of mutually twisted electric wires 10 and coat members 11 for covering the outer periphery of the plurality of electric wires 10, respectively.

The plurality of electric wires 10 are formed in a circular section having a core wire 12 and a coat part 13 for coating the core wire 12, respectively. The core wire 12 is made of a metal such as copper or copper alloy having conductivity, and is formed in a circular section by twisting one conductive wire or plural conductive wires. The coat part 13 is made of a synthetic resin having insulation, and coats the core wire 12 while maintaining the core wire 12 in an insulated state.

The coat member 11 has a conductor layer made of a metal having conductivity including, for example, copper or aluminum, and a thin resin film made of an insulating synthetic resin laminated to the conductor layer, and is formed in a film shape and a band shape. The resin film is provided for the purpose of reinforcement of the conductor layer. Then, the coat member 11 is wound in a sushi roll shape on the outer periphery of the plurality of electric wires 10 in a direction in which the conductor layer makes contact with the coat parts 13 of the plurality of electric wires 10.

The braided wire 4 is formed in a tube shape (bag shape) as a whole by, for example, braiding strands constructed of a conductive metal material etc. The braided wire 4 covers the outer periphery of the plurality of twisted pair wires 3.

The sheath 5 is constructed of a synthetic resin having insulation, for example, polyvinylchloride (PVC). The sheath 5 is formed on the outer periphery of the braided wire 4 for covering the outer periphery of the plurality of twisted pair wires 3 by extrusion molding, and covers the outer periphery of the braided wire 4.

Figure 6:
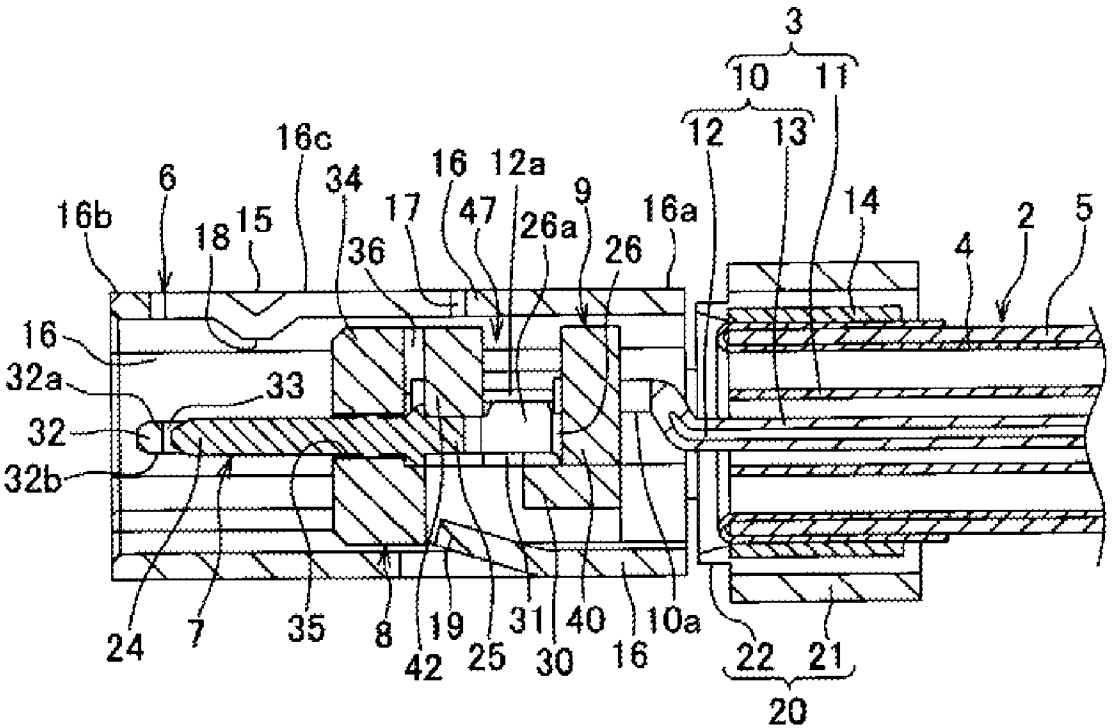
FIG. 6 is a sectional view taken along line VI-VI in FIG. 3.

In the electric cable 2, distal ends of the plurality of twisted pair wires 3 are exposed by folding back the braided wire 4 exposed by removing the sheath 5 by a predetermined length and attaching a ring-shaped fixing member 14 to the outer periphery of this braided wire 4 folded back and fixing the braided wire 4 as shown in FIG. 1 or 6.

Further, in the electric cable 2, each of the coat members 11 of the plurality of twisted pair wires 3 is removed by a predetermined length and each of the electric wires 10 is untwisted and an end 10*a* of each of these electric wires 10 is exposed and thereafter, the coat part 13 of a place separate from the top of each of the electric wires 10 by a predetermined length is removed by a predetermined length, and the core wire 12 of each of the electric wires 10 is exposed to the end 10*a* of each of the electric wires 10 by a predetermined length.

Then, in the electric cable 2, the ends 10*a* of these plural electric wires 10 are respectively attached to an electric wire holder 9 in a state of exposing the core wires 12 of the plurality of electric wires 10 to the ends 10*a* of the plurality of electric wires 10 of each of the plurality of twisted pair wires 3 by the predetermined length.

In addition, in the embodiment, the "ends 10*a*" of the plurality of electric wires 10 exposed by removing each of the coat members 11 of the plurality of twisted pair wires 3 of the electric cable 2 by the predetermined length correspond to "ends" of plural electric wires. Then, "exposed portions" (hereinafter shown by assigning numeral 12*a*) in which the core wires 12 are exposed to the ends 10*a* of the plurality of electric wires 10 of each of the plurality of twisted pair wires 3 by the predetermined length correspond to "exposed portions".

Also, in the embodiment, the exposed portions 12*a* in which the core wires 12 of the plurality of electric wires 10 are exposed to the ends 10*a* of the plurality of electric wires 10 of each of the plurality of twisted pair wires 3 of the electric cable 2 by the predetermined length are formed by removing the coat parts 13 of the places separate from the tops of each of the electric wires 10 by the predetermined length by the predetermined length, but the present invention is not limited to this embodiment and, for example, the exposed portions 12*a* may be formed by removing the coat parts 13 of the tops of each of the electric wires 10 by a predetermined length.

The connector 1 includes a connector housing 6, a plurality of terminal fittings 7, a terminal holder 8 as a terminal holding member for holding the plurality of terminal fittings 7, and the electric wire holder 9 as an electric wire holding member for holding the ends 10*a* of the plurality of electric wires 10 as shown in FIG. 1.

Figure 5:
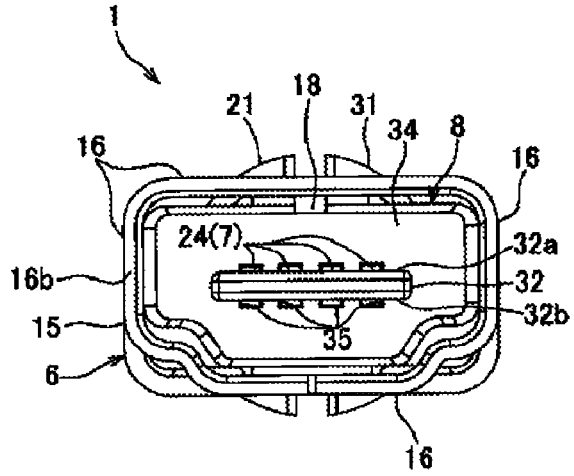
FIG. 5 is a front view of the connector shown in FIG. 3.

The connector housing 6 is made of an insulating synthetic resin, and includes a housing body 15 and a cable insertion part 20 as shown in FIG. 1. The housing body 15 includes plural peripheral walls 16 and is formed in an angular tube shape. The housing body 15 receives the terminal holder 8 and the electric wire holder 9 in the inside as shown in FIG. 5 or 6. Also, a locking protrusion 19 for locking the terminal holder 8 and a lock protrusion 18 for locking a connector housing of the mating connector (not shown) are provided on the housing body 15.

Figure 2:
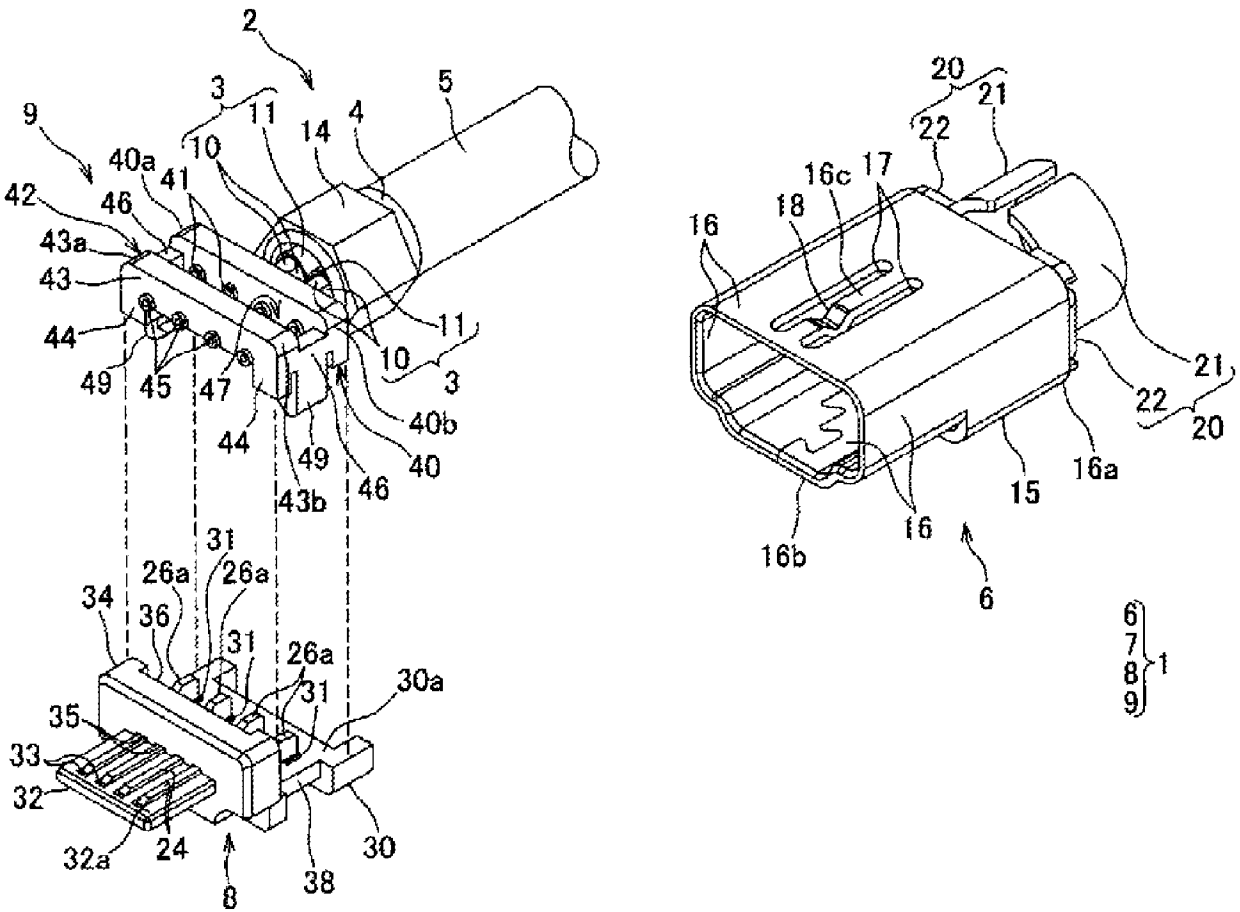
FIG. 2 is a perspective view showing a state in which terminals are attached to a terminal holding member of the connector shown in FIG. 1 and ends of electric wires are held in an electric wire holding member.

The lock protrusion 18 is formed on the housing body 15 in a state of protruding from an inner surface of the one peripheral wall 16 located in the upper portion in the drawing of the housing body 15 to the inside of the housing body 15 as shown in FIGS. 1, 2 and 6. When the connector housing 6 is fitted into the connector housing (not shown) of the mating connector, the lock protrusion 18 engages with the mating connector housing and holds fitting between the connector housing 6 and the mating connector housing.

Figure 3:
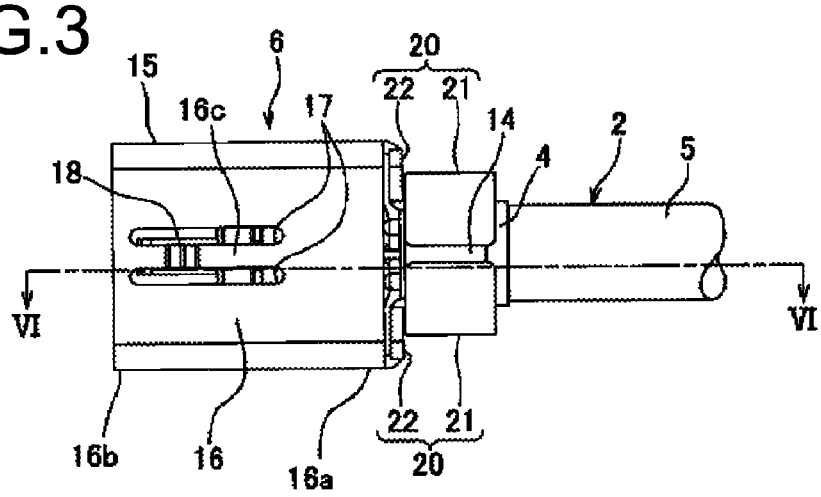
FIG. 3 is a plan view showing a state of assembling the connector shown in FIG. 1.

Also, a pair of notched parts 17 in which the one peripheral wall 16 is linearly notched in a state of sandwiching the lock protrusion 18 between the notched parts 17 is provided in the one peripheral wall 16 of the housing body 15 on which the lock protrusion 18 is formed as shown in FIG. 1 or 3. By providing the pair of notched parts 17, a portion 16*c* between the pair of notched parts 17 of the one peripheral wall 16 bends to the outside of the housing body 15 and the lock protrusion 18 is displaced to the outside of the housing body 15.

The locking protrusion 19 is formed in a state of protruding from an inner surface of the other peripheral wall 16 (located in the lower portion in the drawing) opposed to the one peripheral wall 16 of the housing body 15 to the inside of the housing body 15 and is disposed elastically deformably so as to move near to the inner surface of the peripheral wall 16 of the housing body 15 as shown in FIG. 6. A situation in which the terminal holder 8 comes out of the inside of the housing body 15 is regulated by locking the locking protrusion 19 in the terminal holder 8.

The cable insertion part 20 is connected to one end 16*a* of the side separate from the mating connector (not shown) of the peripheral wall 16 of the housing body 15 and also, a pair of cable insertion parts 20 is disposed as opposed to a width direction (upper and lower directions in FIG. 3) orthogonal to a direction of fitting into the mating connector of the housing body 15.

Figure 4:
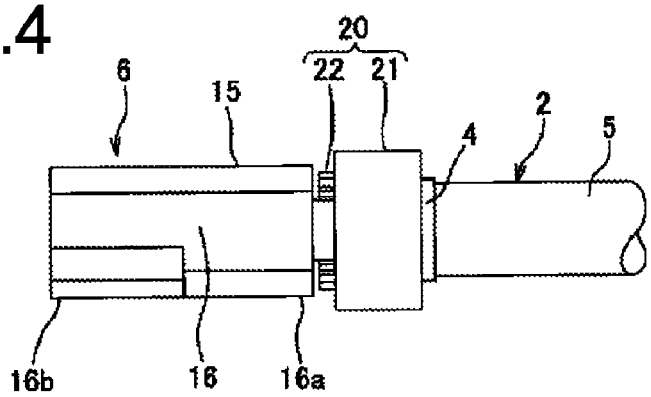
FIG. 4 is a side view of the connector shown in FIG. 3.

The pair of cable insertion parts 20 respectively includes an insertion body 21 with a band plate shape formed in a convex semicircular arc shape toward an outward direction of the housing body 15, and a joint 22 which links to one end 16*a* of the peripheral wall 16 of the housing body 15 and joins the peripheral wall 16 of the housing body 15 to the insertion body 21. The joint 22 is formed in a state of protruding from one end 16*a* of the peripheral wall 16 of the housing body 15 toward the inside of the housing body 15. Then, the electric cable 2 is inserted between the pair of cable insertion parts 20 as shown in FIG. 3 or 4.

The plurality of terminal fittings 7 are respectively made of a conductive metal etc., and the four terminal fittings 7 are disposed in the illustrated example. The plurality of terminal fittings 7 are respectively formed in a bar shape, and integrally include an electric contact part 24 and an electric wire connection part 25. The electric contact part 24 is formed in a prismatic column shape and is electrically connected to a terminal fitting of the mating connector (not shown).

The electric wire connection part 25 links to the electric contact part 24 and is formed in a prismatic column shape. Also, in the electric wire connection part 25, an abutting part 26*a* is formed at one end 26 of the side separate from the electric contact part 24 of the electric wire connection part 25. The exposed portion 12*a* exposed to the end 10*a* of each of the electric wires 10 of the core wire 12 of each of the electric wires 10 is abutted on the abutting part 26*a*.

The abutting part 26*a* protrudes from one end 26 of the electric wire connection part 25 and is formed in a rectangular shape. The abutting part 26*a* is formed so that a length of the abutting part 26*a* along a longitudinal direction of the terminal fitting 7 is substantially equal to a length of the exposed portion 12*a* of the core wire 12 of each of the electric wires 10. In addition, the length of the abutting part 26*a* along the longitudinal direction of the terminal fitting 7 is not limited to this length, and could be a dimension which can overlap with the exposed portion 12*a* of the core wire 12 of each of the electric wires 10.

The terminal holder 8 is made of an insulating synthetic resin, and includes a flat plate part 30 on which the electric wire connection parts 25 of the plurality of terminal fittings 7 are stacked, a receiving part 32 for receiving the electric contact parts 24 of the plurality of terminal fittings 7, and a joint 34 for joining the flat plate part 30 to the receiving part 32 as shown in FIG. 1.

The flat plate part 30 is formed in a flat plate shape with substantially a rectangular plane. Plural projections 31 are disposed on a surface 30*a* of the flat plate part 30. The abutting parts 26*a* of the plurality of terminal fittings 7 are respectively positioned in the plurality of projections 31 when the plurality of terminal fittings 7 are attached to the terminal holder 8. Then, the plurality of projections 31 hold the abutting parts 26*a* of the plurality of terminal fittings 7 in a state of respectively abutting the abutting parts 26*a* on the exposed portions 12*a* of the core wires 12 of the plurality of electric wires 10 when the electric wire holder 9 is attached to the terminal holder 8 as shown in FIG. 2 or 6.

The receiving part 32 is formed in a flat plate shape with substantially a rectangular plane, and a bottom surface 32*b* (shown in FIG. 5 or 6) is arranged so as to be on substantially the same plane as a surface of the projection 31 of the flat plate part 30. Plurality of terminal receiving parts 33 for respectively receiving the electric contact parts 24 of the plurality of terminal fittings 7 are disposed in the receiving part 32. These plurality of terminal receiving parts 33 are formed in a linearly elongated hole shape extending through the receiving part 32. The plurality of terminal receiving parts 33 are mutually spaced in parallel.

The joint 34 is formed in a block shape, and is arranged between the flat plate part 30 and the receiving part 32, and joins the flat plate part 30 to the receiving part 32. A plurality of through holes 35 for inserting the electric contact parts 24 of the plurality of terminal fittings 7 are disposed in the joint 34. The plurality of through holes 35 are mutually spaced. The plurality of through holes 35 respectively link to each of the terminal receiving parts 33 of the receiving part 32.

Also, a recess 36 formed by notching a surface of the side of the flat plate part 30 in a U shape is disposed in the joint 34. The tops of the plurality of electric wires 10 are positioned in this recess 36 when the electric wire holder 9 for holding the ends 10*a* of the plurality of electric wires 10 is attached to the terminal holder 8.

In the terminal holder 8, the electric contact parts 24 of the plurality of terminal fittings 7 are respectively inserted into the plurality of through holes 35 of the joint 34 and are respectively received inside the plurality of terminal receiving parts 33 of the receiving part 32 and the electric wire connection parts 25 of the plurality of terminal fittings 7 are stacked on the flat plate part 30 and also the abutting parts 26*a* of the plurality of terminal fittings 7 are positioned on the projections 31 of the flat plate part 30, and the terminal holder 8 holds the plurality of terminal fittings 7 in a mutually parallel state.

The electric wire holder 9 is constructed of an insulating synthetic resin, and includes a first wall 40, a second wall 42 spaced from the first wall 40 along the longitudinal direction of the plurality of terminal fittings 7 and a joint 46 for joining the first wall 40 to the second wall 42 as shown in FIG. 1.

The first wall 40 is formed in substantially a rectangular flat plate shape and is arranged so that a longitudinal direction of the first wall 40 is parallel to a direction of arrangement of the plurality of terminal fittings 7. A plurality of electric wire insertion holes 41 for respectively inserting the plurality of electric wires 10 are disposed in the first wall 40.

The plurality of electric wire insertion holes 41 extend through the first wall 40 and are formed and also are mutually spaced along the longitudinal direction of the first wall 40. A distance between the plurality of electric wire insertion holes 41 is formed so as to be equal to a distance between the plurality of terminal fittings 7. Then, the ends 10*a* of the plurality of electric wires 10 are respectively inwardly inserted into the plurality of electric wire insertion holes 41, and the portions of the sides of the coat members 11 from the exposed portions 12*a* of the core wires 12 exposed to the ends 10*a* of the plurality of electric wires 10, that is, the ends 10*a* of the plurality of electric wires 10 are held.

The first wall 40 holds the ends 10*a* of the plurality of electric wires 10 at the same intervals as intervals between the plurality of terminal fittings 7 by respectively inserting the ends 10*a* of the plurality of electric wires 10 into the plurality of electric wire insertion holes 41. Then, the first wall 40 forms an electric wire holding part.

The second wall 42 includes a body 43 formed in substantially a rectangular flat plate shape and a pair of erect parts 44 erected from both ends 43*a*, 43*b* of a longitudinal direction of the body 43 toward the terminal holder 8, and is formed in a U shape. The body 43 is arranged so that a longitudinal direction of the body 43 is parallel to the direction of arrangement of the plurality of terminal fittings 7. Also, a plurality of electric wire receiving grooves 45 are disposed in the body 43.

The plurality of electric wire receiving grooves 45 are respectively formed by notching the body 43 in a circular arc shape in a direction separate from the terminal holder 8 from a surface opposed to the terminal holder 8 of the body 43. The plurality of electric wire receiving grooves 45 are mutually spaced along the longitudinal direction of the body 43. A distance between the plurality of electric wire receiving grooves 45 is formed so as to be equal to the distance between the plurality of terminal fittings 7. The plurality of electric wire receiving grooves 45 are respectively arranged concentrically with the respective plural electric wire insertion holes 41.

Also, diameters of the plurality of electric wire receiving grooves 45 are respectively formed slightly smaller than diameters of the electric wires 10. Then, the tops of the plurality of electric wires 10 are respectively inwardly inserted into the plurality of electric wire receiving grooves 45 and the tops of the plurality of electric wires 10 are held.

The second wall 42 holds the ends 10*a* of the plurality of electric wires 10 at the same intervals as the intervals between the plurality of terminal fittings 7 by respectively inserting the tops of the plurality of electric wires 10, that is, the ends 10*a* of the plurality of electric wires 10 into the plurality of electric wire receiving grooves 45 disposed in the body 43. Then, the second wall 42 forms the electric wire holding part.

The joint 46 is formed in a block shape, and a pair of joints 46 is disposed by mutually joining both ends 40*a*, 40*b*, 43*a*, 43*b* of the first wall 40 and the body 43 of the second wall 42 in the of the longitudinal direction thereof as shown in FIG. 1. Then, the pair of joints 46 forms space 47 between the first wall 40 and the body 43 of the second wall 42 by mutually joining both ends 40*a*, 40*b*, 43*a*, 43*b* of the first wall 40 and the body 43 of the second wall 42.

The electric wire holder 9 holds the ends 10*a* of the plurality of electric wires 10 by respectively inserting the ends 10*a* of the plurality of electric wires 10 into the plurality of electric wire insertion holes 41 of the first wall 40 and inserting the ends 10*a* of the plurality of electric wires 10 into the plurality of electric wire receiving grooves 45 of the second wall 42 and thereby, the ends 10*a* of the plurality of electric wires 10 are held in mutually parallel at the same intervals as the intervals between the plurality of terminal fittings 7 and also, the exposed portions 12*a* of the core wires 12 of the plurality of electric wires 10 exposed to the ends 10*a* of the plurality of electric wires 10 are exposed to the outside by the space 47.

Also, retaining portions 38, 49 engaging mutually are disposed in the terminal holder 8 and the electric wire holder 9.

The retaining portion 38 is disposed in the terminal holder 8, and is formed by notching both edges of a width direction of the flat plate part 30, that is, the direction of arrangement of the plurality of terminal fittings 7 in a U shape. That is, a pair of retaining portions 38 is disposed in a state mutually opposed to both edges of the width direction of the flat plate part 30 of the terminal holder 8.

The retaining portion 49 is disposed in the electric wire holder 9, and is formed in a state of protruding from ends of the side of the terminal holder 8 of the pair of respective joints 46 toward the terminal holder 8. That is, a pair of retaining portions 49 is disposed in a state mutually opposed to the pair of joints 46 of the electric wire holder 9. The pair of retaining portions 49 protrudes toward a direction in which the tops mutually approach, and is formed in a hook-shaped section.

Then, when the electric wire holder 9 is attached to the terminal holder 8, the tops formed in the hook shapes of the retaining portions 49 are positioned in the sides, separate from the electric wire holder 9, of the retaining portions 38 and these retaining portions 38, 49 engage mutually and the electric wire holder 9 is mutually fixed to the terminal holder 8 in a state in which the exposed portions 12*a* of the core wires 12 of the plurality of electric wires 10 respectively bring into contact with the abutting parts 26*a* of the plurality of terminal fittings 7.

The connector 1 is assembled as described below. First, the electric cable 2 in which distal ends of the plurality of twisted pair wires 3 are exposed by previously removing the sheath 5 by a predetermined length and folding back the braided wire 4 and fixing the braided wire 4 by the fixing member 14 is inserted into the housing body 15 of the connector housing 6 and between the pair of cable insertion parts 20.

Then, each of the coat members 11 of the plurality of twisted pair wires 3 of the electric cable 2 is removed by a predetermined length and each of the electric wires 10 is untwisted and the end 10*a* of each of the electric wires 10 is exposed and thereafter, the coat part 13 of a place separate from the top of each of these electric wires 10 by a predetermined length is irradiated with a laser and a laser irradiation place is rubbed with a brush etc. and the coat part 13 is removed by a predetermined length and thereby, the exposed portion 12*a* in which the core wire 12 is exposed to the end 10*a* of each of the electric wires 10 by a predetermined length is formed.

Next, as shown in FIG. 2, by respectively inserting the ends 10*a* of the plurality of electric wires 10 into the plurality of electric wire insertion holes 41 of the first wall 40 and inserting the ends 10*a* of the plurality of electric wires 10 into the plurality of electric wire receiving grooves 45 of the second wall 42 and holding the ends 10*a* of the plurality of electric wires 10, the electric wire holder 9 holds the ends 10*a* of the plurality of electric wires 10 in mutually parallel at the same intervals as the intervals between the plurality of terminal fittings 7 and also, the exposed portions 12*a* of the core wires 12 of the plurality of electric wires 10 are positioned in the space 47 and the exposed portions 12*a* are exposed to the outside.

Subsequently, as shown in FIG. 2, the electric contact parts 24 of the plurality of terminal fittings 7 are respectively inserted into the plurality of through holes 35 of the joint 34 and are respectively received inside the plurality of terminal receiving parts 33 of the receiving part 32 and the electric wire connection parts 25 of the plurality of terminal fittings 7 are stacked on the flat plate part 30 and also the abutting parts 26*a* of the plurality of terminal fittings 7 are positioned on the projections 31 of the flat plate part 30 and thereby, the terminal holder 8 holds the plurality of terminal fittings 7 in a mutually parallel state.

Further, the electric wire holder 9 for holding the ends 10*a* of the plurality of electric wires 10 is attached so as to be stacked on the flat plate part 30 of the terminal holder 8 for holding the plurality of terminal fittings 7 and the retaining portions 38 of the terminal holder 8 are mutually locked in the retaining portions 49 of the electric wire holder 9 and thereby, the terminal holder 8 is mutually fixed to the electric wire holder 9 in a state in which the exposed portions 12*a* of the core wires 12 of the plurality of electric wires 10 respectively abut on the abutting parts 26*a* of the plurality of terminal fittings 7.

Then, the abutting parts 26*a* of the plurality of terminal fittings 7 and the exposed portions 12*a* of the core wires 12 of the plurality of electric wires 10 in a state of mutually abutting and being exposed from the space 47 of the electric wire holder 9 are irradiated with a laser and the exposed portions 12*a* of the core wires 12 of the plurality of electric wires 10 and the abutting parts 26*a* of the plurality of terminal fittings 7 are respectively welded and thereby, the plurality of electric wires 10 are connected to the plurality of terminal fittings 7.

Finally, by inserting the terminal holder 8 and the electric wire holder 9 into the housing body 15 of the connector housing 6 and locking the locking protrusion 19 of the housing body 15 in the terminal holder 8 as shown in FIG. 6, a situation in which the terminal holder 8 comes out of the inside of the housing body 15 is regulated, and the terminal holder 8 and the electric wire holder 9 are received inside the housing body 15 of the connector housing 6. In this manner, the connector 1 is assembled.

According to the embodiment, the first and second walls 40, 42 which hold the ends 10*a* of the plurality of electric wires 10 at the same intervals as the intervals between the plurality of terminal fittings 7 and are parallel spaced in the longitudinal direction of the plurality of terminal fittings 7, and the space 47 for exposing the exposed portions 12*a* of the core wires 12 of the plurality of electric wires 10 exposed to the ends 10*a* of the plurality of electric wires 10 are disposed in the electric wire holder 9.

As a result, by attaching the electric wire holder 9 to the terminal holder 8, the ends 10*a* of the plurality of electric wires 10 can be respectively positioned in the plurality of terminal fittings 7 and also the exposed portions 12*a* of the core wires 12 of the plurality of electric wires 10 exposed to the ends 10*a* of the plurality of electric wires 10 positioned in each of the plurality of terminal fittings 7 can be exposed from the space 47 of the electric wire holder 9.

Therefore, positioning of the plurality of terminal fittings 7 and the ends 10*a* of the plurality of electric wires 10 is facilitated and also, the plurality of terminal fittings 7 and the exposed portions 12*a* exposed to the ends 10*a* of the plurality of electric wires 10 of the core wires 12 of the plurality of electric wires 10 can easily be respectively welded by laser welding etc. and thus, connection between the plurality of terminal fittings 7 and the plurality of electric wires 10 can easily be made.

Also, the terminal holder 8 is mutually fixed to the electric wire holder 9 in a state in which the exposed portions 12*a* of the core wires 12 of the plurality of electric wires 10 exposed to the ends 10*a* of the plurality of electric wires 10 respectively abut on one ends 26 of the longitudinal direction of the plurality of terminal fittings 7 by mutually engaging the retaining portions 38, 49 disposed in the terminal holder 8 and the electric wire holder 9.

As a result, the state in which the exposed portions 12*a* of the core wires 12 of the plurality of electric wires 10 exposed to the ends 10*a* of the plurality of electric wires 10 respectively abut on one ends 26 of the plurality of terminal fittings 7 can be held by fixing the terminal holder 8 to the electric wire holder 9, so that the exposed portions 12*a* exposed to the ends 10*a* of the plurality of electric wires 10 of the core wires 12 of the plurality of electric wires 10 can be exposed from the space 47 of the electric wire holder 9 in the state of respectively abutting on one ends 26 of the plurality of terminal fittings 7.

Therefore, the plurality of terminal fittings 7 and the exposed portions 12*a* exposed to the ends 10*a* of the plurality of electric wires 10 of the core wires 12 of the plurality of electric wires 10 can surely be respectively welded by laser welding etc. and thus, connection between the plurality of terminal fittings 7 and the plurality of electric wires 10 can surely be made.

Further, the abutting parts 26*a* in which the length along the longitudinal direction of the plurality of terminal fittings 7 is formed in a dimension which can overlap with the exposed portions 12*a* exposed to the ends 10*a* of the plurality of electric wires 10 of the core wires 12 while protruding from one ends 26 toward the core wires 12 are disposed in one ends 26 of each of the plurality of terminal fittings 7.

As a result, the exposed portions 12*a* exposed to the ends 10*a* of the plurality of electric wires 10 of the core wires 12 of the plurality of electric wires 10 can surely be respectively abutted on one ends 26 of the plurality of terminal fittings 7 in the case of fixing the terminal holder 8 to the electric wire holder 9, so that the exposed portions 12*a* exposed to the ends 10*a* of the plurality of electric wires 10 of the core wires 12 of the plurality of electric wires 10 can be exposed from the space 47 of the electric wire holder 9 in the state of respectively surely abutting on one ends 26 of the plurality of terminal fittings 7.

Therefore, the plurality of terminal fittings 7 and the exposed portions 12*a* exposed to the ends 10*a* of the plurality of electric wires 10 of the core wires 12 of the plurality of electric wires 10 can more surely be welded by laser welding etc.

Also, the connector 1 of the invention can be used in applications other than connection between the electronic components of the electronic devices (a television, a personal computer, a surveillance monitor, etc.) used in a house etc., and can be used in, for example, a network of a building or a wire harness mounted in an automobile.

In addition, the embodiment described above only shows a typical form of the invention, and the invention is not limited to the embodiment. That is, various modifications can be made without departing from the gist of the invention.

The invention is based on Japanese patent application (patent application No. 2008-188448) filed on Jul. 22, 2008, and the contents of which are hereby incorporated by reference.

INDUSTRIAL APPLICABILITY

The invention can provide a connector capable of easily making connection between plurality of terminal fittings and plural electric wires.

REFERENCE SIGNS LIST

1 CONNECTOR
7 TERMINAL FITTING
8 TERMINAL HOLDER (TERMINAL HOLDING MEMBER)
9 ELECTRIC WIRE HOLDER (ELECTRIC WIRE HOLDING MEMBER)
10 ELECTRIC WIRE
10*a* END
12 CORE WIRE
12*a* EXPOSED PORTION (EXPOSED PORTION)
26 ONE END
26*a* ABUTTING PART
38 RETAINING PORTION
40 FIRST WALL (ELECTRIC WIRE HOLDING PART)
41 ELECTRIC WIRE INSERTION HOLE
42 SECOND WALL (ELECTRIC WIRE HOLDING PART)
45 ELECTRIC WIRE RECEIVING GROOVE
47 SPACE
49 RETAINING PORTION

The invention claimed is:

1. A connector comprising:

a plurality of terminal fittings, a terminal holding member that holds the plurality of terminal fittings; and an electric wire holding member that is attached to the terminal holding member and is configured to hold a plurality of electric wires, wherein the electric wire holding member includes:

a pair of electric wire holding parts arranged in parallel with each other, having a space formed therebetween, said pair of electric wire holding parts configured to hold ends of the plurality of electric wires at the same intervals as intervals between the plurality of terminal fittings; and a pair of joints for mutually joining both ends of said pair of electric wire holding parts, wherein the space is defined by the plurality of electric wire holding parts and the pair of joints, the space exposing exposed portions of core wires of the plurality of electric wires to an outside of the electric wire holding member, so as to facilitate connection between the exposed portions and the plurality of terminal fittings.

2. The connector according to claim 1, wherein the terminal holding member is provided with a first retaining portion;

wherein the electric wire holding member is provided with a second retaining portion; and wherein the terminal holding member is mutually fixed to the electric wire holding member in a state that the exposed portions of the core wires of the plurality of electric wires respectively bring into contact with one ends of the plurality of terminal fittings in the longitudinal direction by engaging the first retaining portion with the second retaining portion.

3. The connector according to claim 1, wherein abutting parts protruded from the one ends of the plurality of terminal fittings toward the core wires are formed on the one ends of the plurality of terminal fittings respectively; and wherein lengths of the plurality of terminal fittings in the longitudinal direction are set so that the abutting parts bring into contact with the exposed portions of the core wires respectively.

4. The connector according to claim 1, wherein the plurality of electric wire holding parts hold insulating coat parts of the plurality of electric wires.

5. The connector according to claim 1, wherein the plurality of electric wire holding parts are each formed in a substantially rectangular flat plate shape, and said pair of joints include retaining portions protruding therefrom, for attaching the electric wire holding member with the terminal holding member.

6. The connector according to claim 1, wherein one of the plurality of electric wire holding parts includes a plurality of electric wire receiving grooves spaced in intervals along a longitudinal direction of said one of the plurality of electric wire holding parts, so as to correspond with the intervals between the plurality of terminal fittings.

* * * * *